US011785396B2

(12) United States Patent
Zhang et al.

(10) Patent No.: US 11,785,396 B2
(45) Date of Patent: Oct. 10, 2023

(54) LISTENING EXPERIENCES FOR SMART ENVIRONMENTS USING HEARING DEVICES

(71) Applicant: Starkey Laboratories, Inc., Eden Prairie, MN (US)

(72) Inventors: Tao Zhang, Eden Prairie, MN (US); Dean G. Meyer, Mound, MN (US); Kelly R. Fitz, Eden Prairie, MN (US); Ulrike Axen, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 142 days.

(21) Appl. No.: 15/857,232

(22) Filed: Dec. 28, 2017

(65) Prior Publication Data

US 2018/0192208 A1 Jul. 5, 2018

Related U.S. Application Data

(60) Provisional application No. 62/440,840, filed on Dec. 30, 2016.

(51) Int. Cl.
*H04R 25/00* (2006.01)

(52) U.S. Cl.
CPC ..... *H04R 25/505* (2013.01); *H04R 25/305* (2013.01); *H04R 25/554* (2013.01); *H04R 25/70* (2013.01); *H04R 2225/39* (2013.01); *H04R 2225/41* (2013.01); *H04R 2225/55* (2013.01)

(58) Field of Classification Search
CPC combination set(s) only.
See application file for complete search history.

(56) References Cited

U.S. PATENT DOCUMENTS 8,503,703 B2 8/2013 Eaton et al.
9,326,077 B2 4/2016 Sommer et al.
9,424,843 B2 8/2016 Recker
(Continued)

OTHER PUBLICATIONS

U.S. Appl. No. 62/586,561, filed Nov. 15, 2017, Zhang et al.
(Continued)

*Primary Examiner* — Duc Nguyen
*Assistant Examiner* — Assad Mohammed
(74) *Attorney, Agent, or Firm* — Mueting Raasch Group

(57) ABSTRACT

An Internet-connected system and method for adapting a hearing configuration in a smart environment includes a hearing system including a hearing device. The hearing system connects to the Internet and transmits or receives an identification parameter corresponding to the hearing system. The hearing system receives a hearing program parameter over the Internet for configuring the hearing device when the hearing system is within a smart environment defined by a smart space system. The hearing program parameter computed is based on an environmental parameter measured within the smart environment by a sensor system of the smart space system. The hearing program parameter is sent to the hearing system over the Internet in response to a discovery system of the smart space system detecting the presence of the hearing system in the smart environment in response to receiving the identification parameter. The hearing device is programmed based on the hearing program parameter.

18 Claims, 10 Drawing Sheets

(56) References Cited

U.S. PATENT DOCUMENTS

| | | | | |
|---|---|---|---|---|
| 2006/0193456 | A1* | 8/2006 | Light | G07C 9/27 379/21 |
| 2007/0185980 | A1* | 8/2007 | Abraham | H04L 41/0894 709/222 |
| 2011/0004574 | A1* | 1/2011 | Jeong | G06F 9/5066 706/12 |
| 2012/0183165 | A1 | 7/2012 | Foo et al. | |
| 2013/0177189 | A1 | 7/2013 | Bryant et al. | |
| 2013/0254375 | A1* | 9/2013 | Agiwal | H04L 67/1002 709/224 |
| 2014/0211972 | A1* | 7/2014 | Kim | H04R 25/70 381/314 |
| 2014/0211973 | A1* | 7/2014 | Wang | H04W 8/005 381/315 |
| 2015/0023512 | A1 | 1/2015 | Shennib | |
| 2015/0079962 | A1* | 3/2015 | Baker | H04W 4/023 455/418 |
| 2015/0264721 | A1 | 9/2015 | Shilton | |
| 2015/0296308 | A1 | 10/2015 | Fluckiger et al. | |
| 2016/0174000 | A1 | 6/2016 | Ungstrup et al. | |
| 2016/0212552 | A1 | 7/2016 | Schneider et al. | |
| 2016/0309267 | A1 | 10/2016 | Fitz et al. | |
| 2017/0055126 | A1* | 2/2017 | O'Keeffe | H04W 4/023 |

OTHER PUBLICATIONS

Bluetooth News, "Developing for the IoT? Bluetooth SIG Makes it Easy with Updated Line of Developer Toolkits," Sep. 21, 2016 [retrieved on May 17, 2018]. Retrieved from the Internet: <URL:https://www.bluetooth.com/news/pressreleases/2016/09/21/developing-for-the-iotbluetooth-sig-makes-it-easy-with-updated-line-of-developer-toolkits>; 4 pages.

"IEEE Talks IoT: Rob Fish," Copyright 2018 IEEE [retrieved on May 17, 2018]. Retrieved from the Internet: <URL:https://iot.ieee.org/articles-publications/ieee-talks-iot/109-ieee-talks-iot-rob-fish.html>, 5 pages.

International Search Report and Written Opinion, PCT Application No. PCT/US2017/068776, dated Apr. 9, 2018, 16 pages.

Meyer, "Even Hearing Aids Are Connecting to the Internet of Things," Fortune, Jun. 23, 2016, [retrieved on May 17, 2018]. Retrieved from the Internet: <URL:http://fortune.com/2016/06/23/iot-ifttt-hearing-aid/>; 3 pages.

Oticon ON App, Hearing Aid App, "A world of possibilities," [retrieved on May 17, 2018]. Retrieved from the Internet: <URL:https://www.oticon.com/support/how-to/ifttt>; 7 pages.

* cited by examiner

LISTENING EXPERIENCES FOR SMART ENVIRONMENTS USING HEARING DEVICES

CROSS-REFERENCE TO RELATED APPLICATIONS

The present disclosure claims the benefit of U.S. Provisional Patent Application No. 62/440,840, filed Dec. 30, 2016, entitled INTERNET-CONNECTED HEARING DEVICE, SYSTEM, AND METHOD FOR ADAPTING A HEARING CONFIGURATION IN A SMART SPACE, which is incorporated entirely herein by reference.

TECHNICAL FIELD

The present disclosure relates to hearing devices and smart space systems. In particular, the present disclosure relates to a hearing device that may operatively connect with a smart space system to share resources that may be used to improve listening experiences for one or more users in a smart space or environment covered by the smart space system.

BACKGROUND

Hearing devices provide sound for a user wearing the device. Examples of hearing devices include headsets, hearing assistance devices, speakers, cochlear implants, bone conduction devices, and personal listening devices, etc. Hearing assistance devices provide amplification to compensate for hearing loss by transmitting amplified sounds to their ear canals. In various examples, a hearing assistance device is worn in or around a patient's ear.

Adaptation or adaption in a hearing aid is performed based on acoustic analysis of the signal captured at the hearing aid microphone or based on physical location detection. Hearing assistance devices typically include digital electronics to enhance the wearer's experience. Due to their portable nature and cosmetics, hearing assistance devices often have limited processing power, memory, other computing resources, as well as limited power storage capabilities. Due to these limited resources, hearing assistance devices sometimes lack the practical ability to directly implement some resource-intensive operations, particularly while providing desirable battery life.

The "Internet of Things" (IoT) is a system composed from the computers, smartphones, and tablets connected to the Internet, as well as a vast array of sensors, actuators, and devices that gather, process, and act on data in a connected, autonomous, and "intelligent" fashion. By some projections, there will be as many as 50 billion interconnected devices forming the IoT in the coming decades.

There remains a continuing need to provide hearing devices with improved functionality.

SUMMARY

Various aspects of the present disclosure relate to a hearing device that may be part of a hearing system configured to negotiate with and connect to a smart space system. The smart space system may be unknown to the hearing device until the device enters a smart space, or smart environment, covered by the smart space system and discovery is initiated. The smart space system may provide resources to the hearing device, which may facilitate an improved listening experience, even an improved overall experience, for the user. In particular, one or more hearing devices in the smart environment may be adaptively configured with information collected by the smart space system. The smart space system may, when operatively connected to the Internet, be described as being part of the IoT.

In one aspect, the present disclosure relates to a system for adaptively configuring a hearing device. The system includes a hearing system including the hearing device. The hearing system is configured to connect to the Internet and further configured to transmit an identification parameter corresponding to the hearing system. The hearing system is further configured to receive a hearing program parameters over the Internet for configuring the hearing device when the hearing system is within a smart environment defined by a smart space system. The hearing program parameter is computed based on environmental parameters measured within the smart environment by a sensor system of the smart space system. The hearing program parameter is sent to the hearing system over the Internet in response to a discovery system of the smart space system detecting the presence of the hearing system in the smart environment in response to receiving the identification parameter. The hearing system is further configured to program the hearing device based on the hearing program parameter.

In another aspect, the present disclosure relates to a system for adaptively configuring a hearing device. The system includes a hearing system including the hearing device. The hearing system is configured to connect to the Internet and further configured to detect the presence of a smart environment defined by a smart space system including a sensor system and a discovery system when the hearing system is within the smart environment. The sensor system is configured to measure an environmental parameter within the smart environment. The smart space system is configured to connect to the Internet to send the environmental parameter. The discovery system is configured to broadcast an identification parameter within the smart environment. The hearing system is further configured to receive the broadcasted identification parameter from the smart space system corresponding to the hearing system. The hearing system is further configured to send the broadcasted identification parameter over the Internet. The hearing system is further configured to receive a hearing program parameter over the Internet computed based on the environmental parameter for configuring the hearing device. The hearing system is further configured to program the hearing device based on the hearing program parameter.

In another aspect, the present disclosure relates to a method for adaptively configuring a hearing device. The method includes detecting when a hearing system including the hearing device enters a smart environment defined by a discovery system of a smart space system. The smart space system further includes a sensor system configured to measure an environmental parameter within the smart environment. The smart space system is configured to connect to the Internet to send the environmental parameter over the Internet. The method further includes sending an identification parameter over the Internet to initiate a request for the environmental parameter. The identification parameter corresponds to at least one of the smart space system and the hearing system. The method further includes receiving a hearing program parameter computed based on the environmental parameter over the Internet. The method further includes programming the hearing device based on the hearing program parameter.

It is to be understood that both the foregoing general description and the following detailed description present embodiments of the subject matter of the present disclosure, and are intended to provide an overview or framework for understanding the nature and character of the subject matter of the present disclosure as it is claimed.

Figure 1:
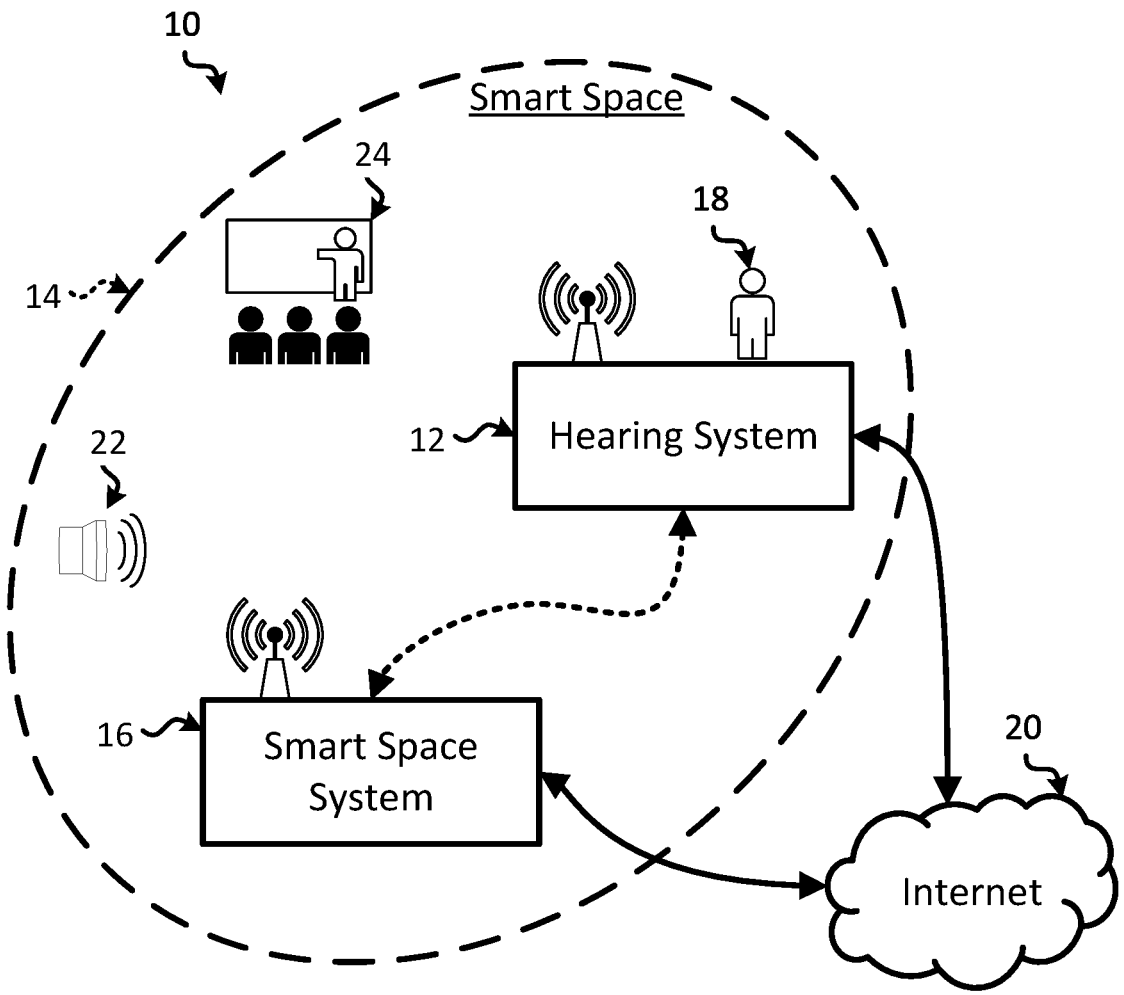
FIG. 1 is a schematic representation of a system having a hearing system and a smart environment defined by a smart space system connected to the Internet.

The disclosure may be more completely understood in consideration of the following detailed description of various embodiments of the disclosure in connection with the accompanying drawings.

DETAILED DESCRIPTION

The present disclosure relates to a smart space system to facilitate improved experiences for users in the smart space. Although reference is made herein to hearing devices, such as a hearing aid, the smart space system may be used with any device capable of negotiating and connecting to the smart space system and benefiting from the availability of additional resources provided by the smart space system. Other applications will become apparent to persons of ordinary skill in the art having the benefit of this disclosure.

It would be beneficial to provide a robust and thorough characterization of a listening environment, or acoustic space, without the need for a user to deploy additional devices or systems to a space. It would also be beneficial to provide capability to take advantage of such characterization in rooms or spaces that are previously unknown to a user or a hearing device, so that upon entering a new room or space, the user can benefit from the hearing device adapting to or being reconfigured to use one or more optimal settings for the new room or space. It would further be beneficial to provide resources to augment the listening experience for the user, which may require additional processing or data storage resources or both, without reducing the useful battery life of the hearing device or increasing the size of the hearing device.

The present disclosure relates to a hearing device that may be part of a hearing system configured to negotiate with and connect to a smart space system. The smart space system may be used to cover a smart environment, and support various functionality within the smart environment. The smart space system may include a network of devices or sensors to collect, process, and generate data. The smart space system may be operatively connected to the Internet, which may expand the network of devices or sensors. The data may be used to adaptively configure one or more hearing devices connected to the smart space system, such as a hearing configuration system. The hearing system may share resources with the smart space system and may be considered part of the smart space system.

Advantageously, the smart space system may provide additional resources beyond those of the hearing device, such as sensing, storage resources, processing resources, and crowd sourcing, which may facilitate enhanced features that improve present or future listening experiences for one or more users in the smart environment. Also, the additional resources may be used to process some tasks normally performed by the hearing device (for example, offloading tasks), which may provide benefits to the battery life of the hearing device and/or improved experience of the users. By joining a network of sensors and computing resources, the hearing system can access and adapt to a much richer collection of information than is available using the hearing devices alone or even coupled with the user's smartphone, which may provide a more robust, effective, and reliable adaptation with less burden on the hearing device and/or the user. The hearing system in conjunction with the smart space system can leverage the greatest possible wealth of information about a listener and the immediate environment, as well as leverage ubiquitous sensing and computing technologies to provide the most personal and responsive hearing enhancement. Further, the enhanced listening experience may provide other benefits to the user, such as enhanced spatial awareness of the smart environment and people or objects within the smart environment, etc. Still further, the smart space system may utilize resources of the hearing device to improve listening experiences for other users. In general, the hearing system may be responsive to the changing needs and demands of listeners in complex and dynamic listening situations.

Upon connection, the smart space system may provide additional computational or data storage resources that may be shared and used to implement some hearing device functionality. Typically, the resources of the system are greater than the resources of the hearing device or even a mobile device, such as a smartphone or tablet. The system may be coupled to utility lines or other non-portable power sources, so the system resources may not be limited by battery life. The system may also facilitate generating additional data with additional numbers of sensors, or even additional types of sensors, beyond those provided by the hearing device or mobile device. The additional data may facilitate making certain measurements, monitoring, or characterizations of the environment that may not have been available using only a hearing device or mobile device.

In particular, the system may utilize a network of devices or sensors (other than those carried by the user) to collect environmental data on demand, send that information to a remote system (for example, server), receive hearing aid settings appropriate to the environment back from the remote system, and reprogram the hearing aid with the new environmentally appropriate settings. Such data can also be collected, stored, and mined to capture and learn from large volumes of field data produced by hearing aid user (for example, wearer). Such processing of data can be performed utilizing on one or more hearing configuration systems provided by, for example, a hearing configuration service provider over the Internet.

The hearing device and related systems may be able to access sensor data and hearing-related services techniques for the discovery and opportunistic employment of sensors (microphones, for example, but also non-acoustic sensors) and beacons in the environment (for example, in a smart space system). As the number and density of sensors in the world increases, the burden of awareness and tracking of those sensors by the hearing device need not increase.

In many cases, the hearing system and the smart space system are unaware of one another until the user first enters the smart environment. The smart space system may be unknown to the hearing device until the device enters the smart environment and discovery is initiated. Discovery may be a key feature of the system. Discovery may include a negotiation process between the hearing system and the smart space system. Information about the purpose or need of the hearing system or the smart space system may be exchanged. For example, when a hearing system enters into a smart meeting room, it may first try to discover the smart space system using a generic IoT protocol. Once the two systems recognize each other as IoT compatible, the hearing system may inform the smart space system that its purpose is to enhance its user's listening experience and requests from smart space system additional microphones in the room, additional processing, additional storage resources, and prior user experiences. The smart space system may respond to the hearing system request by providing the availability of 5 microphones and their locations, 10 TB of hard drive space, a high-power computer with GPU, and the experience data from 50 other hearing device users. The hearing system may decide to leverage 3 out of the 5 microphones to enhance its conference call capability, off-load environment characterization tasks to the smart space system, optimize its settings based on other hearing system user experiences in this room, and provide its own experience to the smart space system before leaving the room. For example, the smart space system may lend its resources to the hearing system and, in turn, receive the user's feedback and use it to optimize experiences for additional hearing device users of the smart room.

When the hearing system or smart space system are operatively connected to the Internet, the systems may be described as being part of the IoT. The hearing system may activate IoT functionality any time the system is in operating in proximity of other IoT-aware devices, nodes, or beacons, specifically, in proximity to IoT-accessible sensors and devices that can provide useful resources to the hearing device, or vice versa, such as information that might help characterize the acoustic environment.

IoT devices or nodes can advertise their presence by broadcasting identifiers in the form of unique Internet addresses, such as uniform resource locators (URLs). When discovering an IoT node, an IoT-aware device can follow such a URL to a networked system or server that can provide arbitrary information about the space and access to sensors in that space. Significantly, all the information and sensor data can be used to enhance the user's experience without the user or the manufacturer of the IoT-aware device ever previously having been aware of that space, or requiring the user to populate the space with beacons.

IoT-enabled sensors and devices, or local networks of them, may only be known to a single, internetworked system or server. A local beacon may broadcast a unique identifier and the URL of that server, and interested parties (for example, hearing devices using a smartphone as a proxy) can communicate and negotiate with that server for the collected sensor data and, under some models, access to the sensors themselves. In this way, the number and variety of available sensors can be greatly increased with no management overhead and no action required of the user. The use of networked hearing devices, the use of sensor networks, and the exchange of data between hearing devices and phones and servers can leverage existing communication protocols for implementing the discovery and joining of new and previously unknown networks.

Many of the devices on the IoT will be wearable, like hearing devices, but many more of them will not, and these stationary devices and sensors that reside permanently in a particular acoustic environment may be able to provide useful information for environment and situation adaptation that would be difficult to collect on demand using the hearing devices themselves, or even a user's smartphone. For example, "The reverberation time in this room is 200 ms," "There's a radio in this room," "I'm a TV, and I'm tuned in to a basketball game right now," "This is a conference room, there are four other people and an active videoconferencing system in here," etc. Access to this kind of information can provide a wealth of previously unavailable data that can be used to understand and adapt an individual patient's pattern of listening demands and environments.

The system described by the present disclosure can support a great variety of applications. For example, the system may support a smart environment that is indoors or outdoors, such as a smart room, a smart building, a smart park, a smart street, a smart city, a smart car, a smart train, a smart airplane, a smart cruise ship, etc.

One example of an indoor smart environment is a "smart" conference room that contains sensors (such as microphones) that can provide acoustic (for example, noise level, reverberation) and non-acoustic (for example, number of occupants, locations of teleconference loudspeakers) data that can be used to configure a hearing device.

On example of an outdoor smart environment is a "smart" park that may be used for a concert. Various sensors, such as microphones of other mobile devices or the concert sound system itself, may be used to provide information to determine, for example, the location of the singer on stage, the kind of music being played, or the size of the crowd. Some of the information may be received, for example, over the Internet. The information may be used to configure a hearing device to provide, for example, spatial enhancement of the sound of the music or to enhance the sound of the music being played and mitigate the sound of other noise, such as the crowd.

As used herein, the term "spatial enhancement" refers to modifying a sound provided to the ears of the user to provide better spatial perception. Spatial perception of a sound may be influenced by shape of the ear, which allows the user to determine whether sound is emanating from the left, right, front, behind, or even above or below, the user. Spatial enhancement may include taking a sound that is agnostic to direction and processing it to provide sound from which the user may be able to better determine a direction associated with the sound. In particular, a virtual location of a sound source may be computed and applied to a sound. In one example, music may be provided that has no direction associated to it. The music may be spatially enhanced so that the user may perceive that the music is coming from the direction of the stage.

Another example of an outdoor smart environment is a "smart" street. Upon detecting the location of the user, the hearing device may identify, for example, a crosswalk and associated traffic light. Various sensors, such as microphones, cameras, and motion sensing near the crosswalk, may be used to characterize the typical street characteristics. These characteristics may be used to generate a hearing configuration for the hearing device that minimizes certain street noise. The smart space system may also have information about the crosswalk voice used to help the visually impaired. A hearing configuration may be generated that enhances the crosswalk voice based on this information. Further types of information may be provided, such as general traffic information.

A user may enter an environment occupied by an IoT device, and the hearing device is automatically configured in a way that is optimized or customized for that room and/or that listener in that space, according to data retrieved from a remote system or server (for example, hearing configuration system), possibly modulated a by detected acoustic or non-acoustic environment, possibly awaiting confirmation from the user that the new settings are acceptable, and possibly sending that confirmation back to the system, that, in turn, learns to provide better recommendations with greater confidence over time.

Some sensors in a network may provide unreliable or incomplete information. Through the system, a hearing device could collaborate with other devices to contribute to a more complete characterization of a situation or environment. For example, the hearing device could connect with other nodes, which may be non-wearable, to corroborate or enhance its analysis of an acoustic environment (for example, "Is it really that noisy? Are there really that many people in here? How many talkers do you see?" or "I find it noisy and reverberant in here, can you tell me what the reverb time is?"), that the hearing device can then use to improve or enhance the listening experience for the user. Alternatively, the hearing device can provide its mobile perspective on the acoustic environment to another stationary node that is performing some other service. In some cases, these scenarios could involve downloading and deploying some ephemeral code or application to perform some assessment or characterization.

In a further example, the user can control and interact with a hearing device using natural spoken language (a mobile device, like SIRI® by Apple, Inc., or a non-mobile device, like ALEXA® by Amazon.com, Inc.). Implementing natural language voice processing on a hearing device may not be practical, so processing can be performed on other devices that might be IoT-connected devices (like AMAZON ECHO® by Amazon Technologies, Inc., or other similar devices). Users can take advantage of proximity to such devices. For example, one could walk into their living room and tell the device to switch to an enhanced music listening mode. One technique for interacting with a hearing device is described in U.S. Provisional App. No. 62/586,561 (Zhang et al.), filed Nov. 15, 2017, entitled "INTERACTIVE SYSTEM FOR HEARING DEVICES," which is incorporated entirely herein by reference.

In a yet another example, the IoT-enabled hearing device need not be restricted to environment detection and adaptation. Connection to the IoT and cloud computing and storage resources implies that data can be collected and processed over a period of seconds, minutes, hours, days, weeks, or months to assemble a portrait of the user's listening habits and activities. A rich dataset can be collected by taking advantage of a sensor network, without requiring the user's active engagement. In this way, the IoT-enabled device can support not only greatly enhanced environment adaptation, but also greatly enhanced experience management.

As used herein, the term "hearing device" means a device for providing audio-related content to a user. For example, the hearing device may assist or augment the auditory environment of the user or otherwise provide audio content to the user. For example, the hearing device may provide a processed version of the audio content heard by the user to enhance the auditory experience of the user (for example, compensating for a hearing impairment). As another example, the hearing device may provide audio content to the user based on data received from another device or system, locally or other the Internet, by the hearing device (for example, a direct or composite room microphone feed, a videoconference audio stream, a teleconference audio stream, background music, or advertising). The hearing device may have one or more settings that can be changed based on one or more hearing program parameters. A hearing device may include hearing assistance devices, or hearing aids of various types, such as behind-the-ear (BTE), in-the-ear (ITE), in-the-canal (ITC), receiver-in-canal (RIC), completely-in-the-canal (CIC), or invisible-in-the-canal (IIC)-type hearing aids. It is understood that BTE type hearing aids may include devices that reside substantially behind the ear or over the ear. Such devices may include hearing aids with receivers associated with the electronics portion of the device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted, or occlusive fitted. The present subject matter may additionally be used in consumer electronic wearable audio devices having various functionalities. It is understood that other devices not expressly stated herein may also be used in conjunction with the present subject matter.

The term "hearing system" means a system that includes the hearing device and optionally includes another device or devices operatively connected to the hearing device (for example, mobile smartphone or non-wearable device, and some cloud-connected devices). The hearing system may be connected to the Internet. One or more devices in the hearing system may be connected to the Internet. In some embodiments, only some devices may be connected to the Internet and other devices can be connected to the Internet through those devices. The hearing system may be configured to discover or be discovered by a smart space system. The hearing system may be configured to receive or be configured based on environmental parameters provided by the smart space system. The hearing system may communicate with other system over the Internet, such as a hearing configuration system, a local data system, or other remote device or system over the Internet. The hearing system may be configured to interact with a user. The hearing device may be configured at least partially based on the user interaction. The user interaction can include the hearing system providing information to the user based on data provided by a smart space system (for example, settings based on parameters related to optimizing listening in a particular smart environment) and input from the user to the hearing system (for example, "How does this setting sound?").

The term "smart space system" means a system defining and corresponding to a smart environment. The smart space system may include a discovery system and a sensor system. The sensor system may include one or more sensors to detect certain acoustic or non-acoustic environmental parameters within the smart environment. An example of an acoustic sensor includes a microphone. An example of a non-acoustic sensor includes an optical beam configured to detect crossings proximate to, adjacent to, or at a threshold, or boundary, of the smart environment. The discovery system may include devices for discovering or being discovered by near-field or other local wireless communications. For example, the discovery system may be configured to "listen" for a wireless beacon from the hearing system and the discovery system may act upon discovering the hearing system. In another example, the discovery system may provide a wireless beacon that a hearing system can "listen" for. In some embodiments, the smart space system can provide additional data to the hearing device after the discovery process. For example, the smart space system may provide audio content to device or system within the smart environment, locally or other the Internet, the source of which may or may not originate within the smart environment (for example, a direct or composite room microphone feed, a videoconference audio stream, a teleconference audio stream, background music, or advertising).

The term "user" means a user of a hearing device. A user may be wearing the hearing device while the hearing device is in use. The user may also be interacting with a device operatively connected to the hearing device, such as a mobile device, for example, during configuration of the hearing device.

The term "identification parameter" means data that can be used to uniquely identify one or more components related to the system. For example, an identification parameter can be used to identify a hearing system, in particular the mobile device, the hearing device, and/or the user of the hearing system. As another example, an identification parameter can be used to identify a smart space system, which may be associated with a smart environment and one or more sensor(s) of the smart space system. The identification parameter can be a unique address, such as a Uniform Resource Location (URL) that is a unique identifier for use with the Internet. The identification parameter can also be encoded to be interpretable by only certain systems (for example, only authorized or privileged systems), such as a hearing configuration system, so that a user's personal information is generally unavailable to other systems, such as the smart space system or others systems on the Internet that may receive the identification parameter.

The term "environmental parameter" means data that characterizes a smart environment. The environmental parameter may include acoustic data, non-acoustic data, or both. Non-limiting examples of acoustic data include a sound level, a sound spectrum, and a reverberation characteristic. Non-limiting examples of non-acoustic data include a number of occupants and a location of an audio source. The environmental parameter may be measured or determined (for example, computed) based on multiple measurements. The environmental parameter may be measured or determined by a sensor system of a smart space system. The environmental parameter may also be determined by another system, such as a local data system. Multiple measurements may be taken over time or from different types of measurements. The environmental parameter may reflect a real-time representation of the smart environment (for example, short interval measurements or measurements while a hearing system is in the smart environment), an historic representation of the smart environment (for example, an average over time or another past time related to the current time), or both.

The term "hearing program parameter" means data that is used for programming the hearing device. The hearing device may have one or more settings that can be changed based on one or more hearing program parameters. Non-limiting examples of settings include a gain, a compression characteristic, a time constant, a threshold sound level, or any other signal processing algorithm parameter. The hearing program parameter may be determined based on an environmental parameter(s) and, optionally, an identification parameter(s) or a user interaction(s). The identification parameter may relate to a user parameter(s), which may be stored, for example, on a hearing configuration system and may include a degree of hearing loss or a user preference. The hearing program parameter may be determined or computed by a hearing configuration system or the hearing system. Some example techniques for determining a hearing program parameter are described in U.S. patent application Ser. No. 15/130,020, entitled "User Adjustment Interface Using Remote Computing Resource," filed on Apr. 15, 2016, which claims the benefit of U.S. Provisional Patent Application Ser. No. 62/147,975, entitled "Automatic Hearing Aid Adjustment Using Remote Acoustic Scan Analysis and Machine Learning," filed on Apr. 15, 2015, which are incorporated herein in their entirety.

The term "hearing configuration system" means a computing and data storage system that can compute a hearing program parameter for programming a hearing device. The hearing configuration system may be maintained and hosted by a hearing configuration service provider. The hearing configuration service provider may also be the same entity, or an entity affiliated with, the manufacturer or provider of the hearing device. The hearing configuration system may include or have access to personal information about a user of the hearing device, which may aid in determining optimal settings for the hearing device for computing the hearing program parameter. The hearing configuration service provider may determine the identity of the user or the hearing device based on an identification parameter received over the Internet.

A hearing configuration system may store aggregated or statistical information about user preferences in a particular smart environment or type of smart environment. The hearing configuration system may determine that 90% of users prefer two settings in this smart environment. These settings may be used to update the hearing configuration of the hearing device, automatically or manually, upon connection or location determination.

The hearing configuration may be dynamically loaded onto the hearing device. For example, the hearing system may identify that the user is going to a concert using, for example, access to calendar data or user input. Before the concert starts, the hearing device may be loaded with a configuration that enhances spoken sounds to facilitate conversations. When the concert starts, the heating device may be loaded, automatically or manually, with a different configuration that enhances music and dampens crowd noise.

Reference will now be made to the drawings, which depict one or more aspects described in this disclosure. However, it will be understood that other aspects not depicted in the drawings fall within the scope of this disclosure. Like numbers used in the figures refer to like components, steps, and the like. However, it will be understood that the use of a reference character to refer to an element in a given figure is not intended to limit the element in another figure labeled with the same reference character. In addition, the use of different reference characters to refer to elements in different figures is not intended to indicate that the differently referenced elements cannot be the same or similar.

FIG. 1 is a schematic representation of a system 10 having a hearing system 12 and a smart environment 14 defined by a smart space system 16 connected to the Internet. The system 10 is an application of the "Internet of things" concept that facilitates the collection of new types and amounts of data that can improve the experience for a user of a hearing device (see FIG. 3), particularly in new smart environments previously unknown to the user or hearing device, as well as smart environments that have dynamically changing acoustic characteristics. Further, connecting to the Internet means connecting to remote computational resources (for example, "cloud computing") that can offload computational demands to other systems than the portable hearing system carried by a user 18. The hearing system 12 and the smart space system 16 can discover the other (for example, unidirectionally or bidirectionally) and communicate over the Internet 20 according to a predefined protocol (for example, the "physical web"). In some embodiments, only the hearing system 12 discovers the smart space system 16, or vice versa. In some embodiments, both the hearing system 12 and the smart space system 16 discover one another.

In some embodiments, the user 18 wearing the hearing device can enter the smart environment 14, and the hearing device is automatically configured in a way that is optimized or customized for that room and/or that user as a listener in that space, according to data retrieved from a remote hearing configuration system, possibly modulated by detected acoustic (or otherwise) environment, possibly awaiting confirmation from the user that the new settings are acceptable, and possibly sending that confirmation back to the hearing configuration system, that, in turn, learns to provide better recommendations with greater confidence over time.

Figure 4:
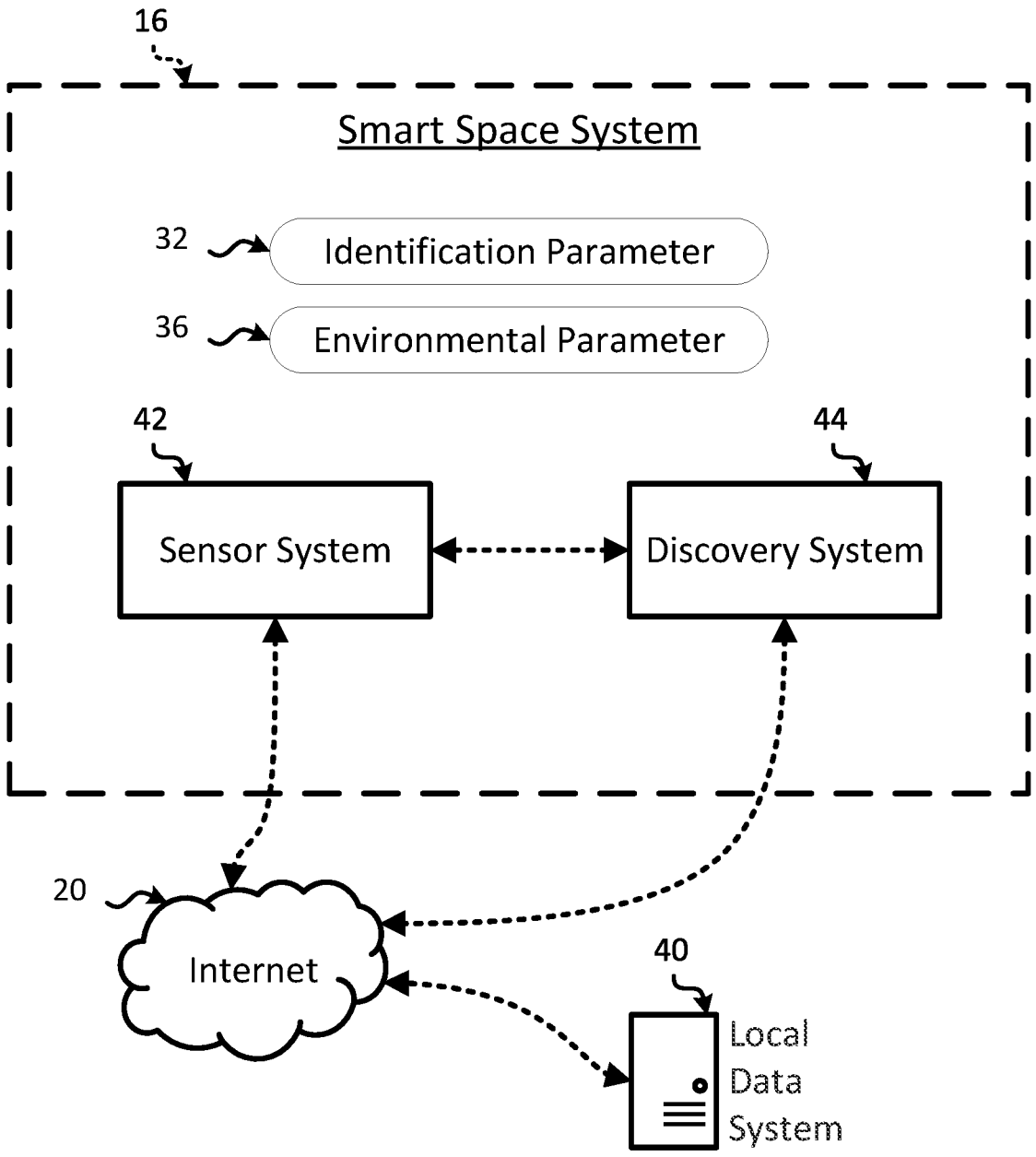
FIG. 4 is a schematic representation of the smart space system of FIG. 1 connected to a local data system.

As illustrated, the smart environment 14 is defined by the smart space system 16, which may include a sensor system and a discovery system (see FIG. 4). The smart environment 14 may also include audio sources, such as a loudspeaker 22 and a speaker 24 (for example, presenter). The hearing system 12 can be detected by the smart space system 16 when the hearing system is within the smart environment 14, or vice versa. The sensor system, the discovery system, or both may influence the extent of the smart space 14. The sensor system may define spaces where smart environment characteristics can be measured. The discovery system may define the same or different spaces where a hearing system can actually be detected, or the hearing system can detect the discovery system. The discovery process and the sensor collection process may use near field communication or other localized communication to carry out their functionality (for example, discovering other systems and transmitting environmental data). In some embodiments, communication between the discovery system and the sensor system is not necessary to carry out their functionality. However, in some embodiments, the discovery system and the sensor system may communicate with one another. The Internet 20 can be utilized for requesting data and transferring data used in programming the hearing device so that additional information and computing can be offloaded from the hearing system 12 and/or the smart space system 16.

Figure 2:
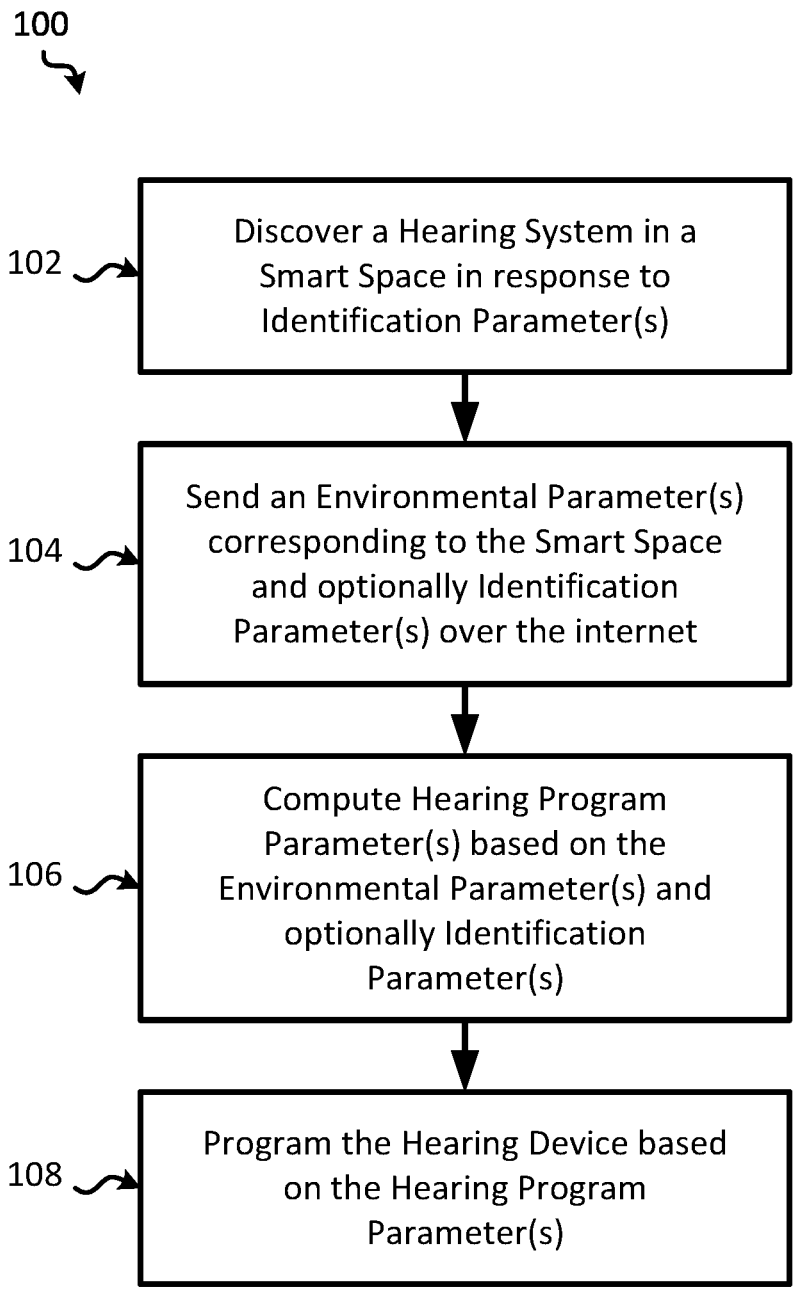
FIG. 2 is a process representation of a method for adaptive configuration of the hearing device using the system of FIG. 1.

FIG. 2 is a representation of a process 100 for adaptive configuration of the hearing device that can be used with the system 10. The process 100 can be described at a high level in four basic steps: discovery 102, sending data over the Internet 104, computing hearing device settings 106, and programming the hearing device 108. In particular, in step 102, a hearing system can be discovered in a smart environment in response to identification parameters. For example, an identification parameter may be transmitted by the hearing system. In step 104, an environmental parameter is sent corresponding to the smart environment over the Internet. An identification parameter is also optionally sent over the Internet. In step 106, a hearing program parameter is computed based on the environmental parameter. The hearing program parameter may be further based on the optional identification parameter. In step 108, the hearing device is programmed based on the hearing program parameter.

Figure 3:
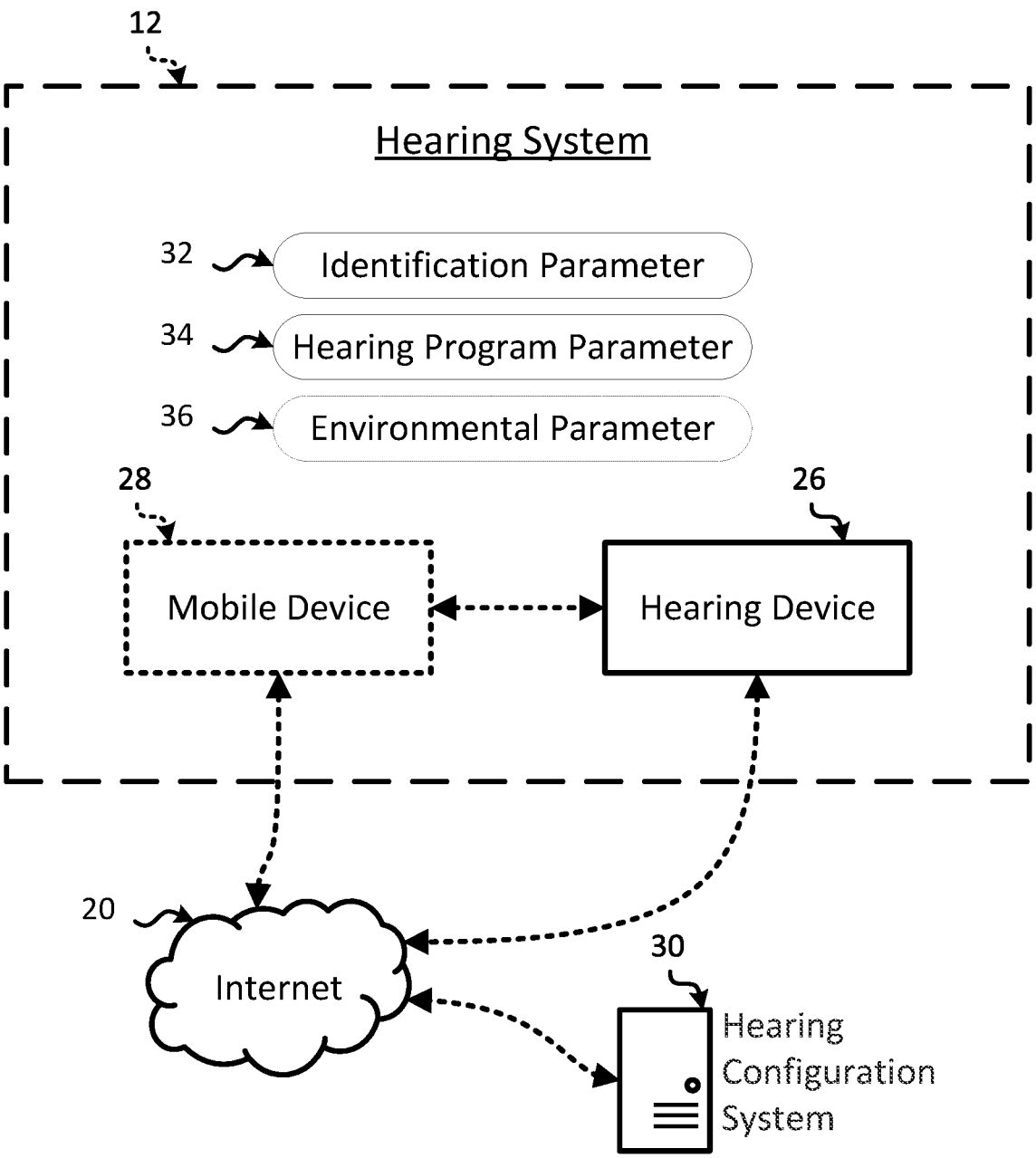
FIG. 3 is a schematic representation of the hearing system of FIG. 1 connected to a hearing configuration system.

FIG. 3 is a schematic representation of the hearing system 12 connected to a hearing configuration system 30. The hearing system 12 includes a hearing device 26, which may be worn by a user. The hearing device 26 may be connected directly to the Internet 20. The hearing system 12 may include an optional mobile device 28 operatively connected to the hearing device 26 and connected to the Internet 20. The hearing device 26 may be connected indirectly to the Internet 20 through the mobile device 28. Much of the functionality of the hearing system 12 described herein may be carried out by the mobile device 28 or the hearing device 26. In some embodiments, the functionality may alternatively or additionally be carried out by a device or system remote from the hearing system that is accessible over the Internet 20 (for example, other than the hearing configuration system). The allocation of functionality may depend on the processing power, battery capacity, or other features of the respective device.

The hearing system 12 may be connected over the Internet 20 to the hearing configuration system 30. The hearing configuration system 30 may provide a hearing program parameter 34 to the hearing system 12 for programming the hearing device 26. The hearing program parameter 34 may be computed by the hearing configuration system 30 based on an environmental parameter 36 received by the hearing configuration system 30 over the Internet 20, for example, from a local data system 40 (see FIG. 4). The hearing program parameter 34 may be received and stored on the mobile device 28 or the hearing device 26. When received by the mobile device 28, the hearing program parameter 34 can be sent to the hearing device 26 for programming.

The hearing program parameter 34 may also be computed based on an identification parameter 32 received by the hearing configuration system 30 over the Internet 20. The identification parameter 32 can correspond to the hearing system 26, the smart space system 16 (FIG. 1), or both (for example, include a unique identifier for the hearing system and another unique identifier for the smart space system). With the identification parameter 32, the hearing configuration system 30 may compute a hearing program parameter 34 based on, for example, the identity of the hearing device 26, the identity of the mobile device 28, the identity of the user 18 (FIG. 1), the identity of the smart space system 16 (FIG. 1), and/or the identity of the sensor system (see FIG. 4).

By providing a hearing program parameter 34 based on the environmental parameter 36 and/or the identification parameter 32, the hearing device 26 can be configured responsive to the smart environment. With the available data, the optimal settings for a hearing device 26 represented by a hearing program parameter 34 can be provided in a variety of ways. Non-limiting examples of computing a hearing program parameter 34 include: using settings the user previously applied successfully in similar rooms and spaces, using settings that other users of similar devices or hearing profiles applied successfully in the present or similar smart environment, fine tuning tools that offer a specific range and variety of adjustments that are appropriate for the present room or space, or combinations thereof.

The identification parameter 32 may be stored or received by the hearing system 12. In some embodiments, the identification parameter 32 is stored by hearing system 12 and corresponds to the hearing system. In some embodiments, the identification parameter 32 is received by the hearing system 12 and may correspond to the smart space system (for example, a URL for connecting to a local data system over the Internet).

In some embodiments, the hearing system 12 can compute the hearing program parameter 34. The mobile device 28 optionally may receive the environmental parameter 36 and compute the hearing program parameter 34 based on the environmental parameter 36.

In some embodiments, the hearing configuration system 30 is implemented in the hearing system 12, for example, an application on the mobile device 28.

The hearing system 12 may transmit a signal that is detected within the smart environment as part of the discovery process, which may begin the discovery process. For example, the mobile device 28 or the hearing device 26 may broadcast an identification parameter 32 that is detected by a discovery system 44 (see FIG. 4).

In some embodiments, the hearing system 12 may detect a signal within the smart environment as part of the discovery process, which may begin the discovery process. For example, the discovery system of the smart space system may broadcast an identification parameter 34 that is detected by the mobile device or the hearing device.

FIG. 4 is a schematic representation of the smart space system 16 connected to a local data system 40. The smart space system 16 may include a sensor system 42 and a discovery system 44. The sensor system 42, the discovery system 44, or both may be connected to the Internet 20. The sensor system 42 may optionally communicate with the discovery system 44. The sensor system 42 may include one or more environmental sensors (not shown) that can measure characteristics in the smart environment. The sensor system 42 may provide one or more environmental parameters 36 that are available over the Internet 20.

In some embodiments, the sensor system 42 is connected to the local data system 40. The environmental parameters 36 may be received and stored on the local data system 40. A request may be sent to the local data system 40, which may send the environmental parameter 36 over the Internet 20. The local data system 40 may be remote from the smart space system 16 and connected over the Internet 20. Alternatively, the local data system 40 may also be considered part of the smart space system 16. For example, the local data system 40 may be within the smart environment and operatively connect to the sensor system 42 or discovery system 44 without using the Internet 20.

Environmental parameters 36 may be sent from the sensor system 42 to the local data system 40 ad hoc, at regular intervals, or by request, for example, by the sensor system 42, discovery system 44, local data system 40, or hearing system 12 (FIG. 1).

One sensor or only some sensors may not provide a complete characterization of the smart environment. A hearing device could collaborate with other devices within the smart environment (for example, other sensors or non-user hearing systems) to contribute to a more complete characterization of a situation or environment. For example, the hearing device could connect with other devices, which may be non-wearable, to corroborate or enhance its analysis of an acoustic environment (for example, "Is it really that noisy? Are there really that many people in here? How many talkers to you see?" or "I find it noisy and reverberant in here, can you tell me what the reverb time is?"), that can be used to calculate or adjust the hearing program parameter to improve or enhance the listening experience for the user. Alternatively, the hearing device could provide its mobile perspective on the acoustic environment to the smart space system, which may be performing some other service for other hearing devices or other types of devices. In some cases, code or an application can be downloaded over the Internet and deployed to perform some assessment or characterization on the hearing system, the smart space system, or both.

Environmental parameters 36 or data for calculating an environmental parameter 36 can be collected and processed over a period of seconds, minutes, hours, days, weeks, or months to assemble a portrait of the smart space's static and dynamic characteristics. The hearing device can be programmed based on this collected and processed data without requiring additional time or action by the user of the hearing device.

In some embodiments, the user can interact with the hearing system using natural spoken language via the smart space system. This may allow natural-language processing to be offloaded from the hearing device and even the mobile device to other systems, such as the hearing configuration system or the smart space system, to improve the perceived spoken language response of the hearing system. In one example, the user could walk into a living room with a smart space sensor having a microphone and tell the smart space system to switch to an enhanced music listening mode, which reprograms the hearing device. One technique for interacting with a hearing device is described in U.S. Provisional App. No. 62/586,561 (Zhang et al.), filed Nov. 15, 2017, entitled "INTERACTIVE SYSTEM FOR HEARING DEVICES," which is incorporated entirely herein by reference.

The discovery system 44 may transmit or receive a signal that initiates the discovery process. For example, the discovery system 44 can transmit a signal within the smart environment that can be detected by the hearing system within the smart environment, or vice versa. The signal may include an identification parameter 32. In some embodiments, the hearing system and the smart space system 16 do not need to communicate directly other than the transmission of an identification parameter 32. For example, all other data may be sent and received over the Internet. In some embodiments, the signal may also or alternatively initiate a handshake-type process. For example, the system receiving the signal may respond to the signal within the smart environment.

The identification parameter 32 may be stored or received by the smart space system 16. In some embodiments, the identification parameter 32 is stored by smart space system 16 and corresponds to the smart space system. In some embodiments, the identification parameter 32 is received by the smart space system 16 and may correspond to the hearing system (for example, a unique identifier for a hearing configuration system to identify the hearing system over the Internet).

Figure 5:
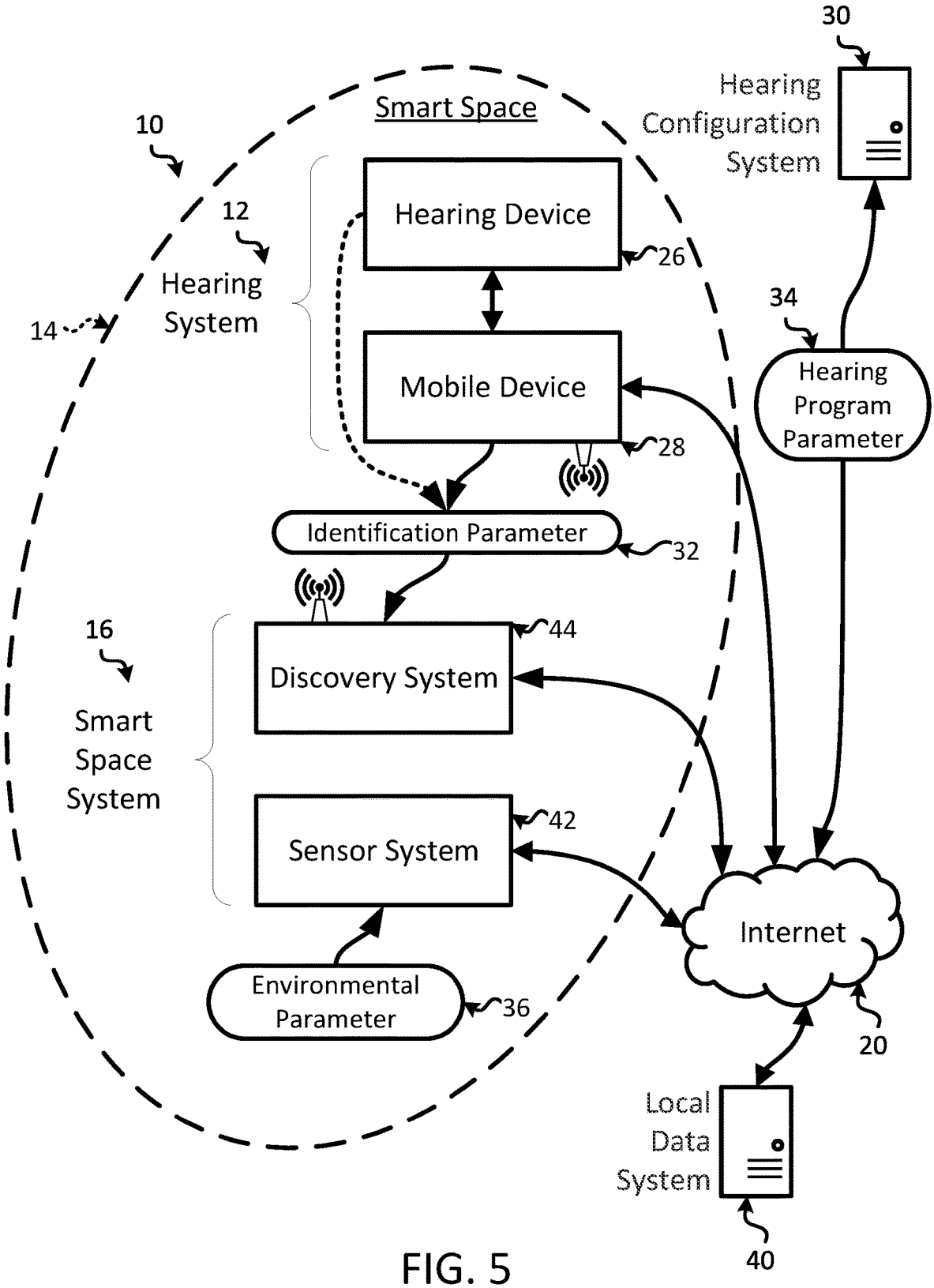
FIG. 5 is a schematic representation of an example configuration for the system of FIG. 1.
Figure 6:
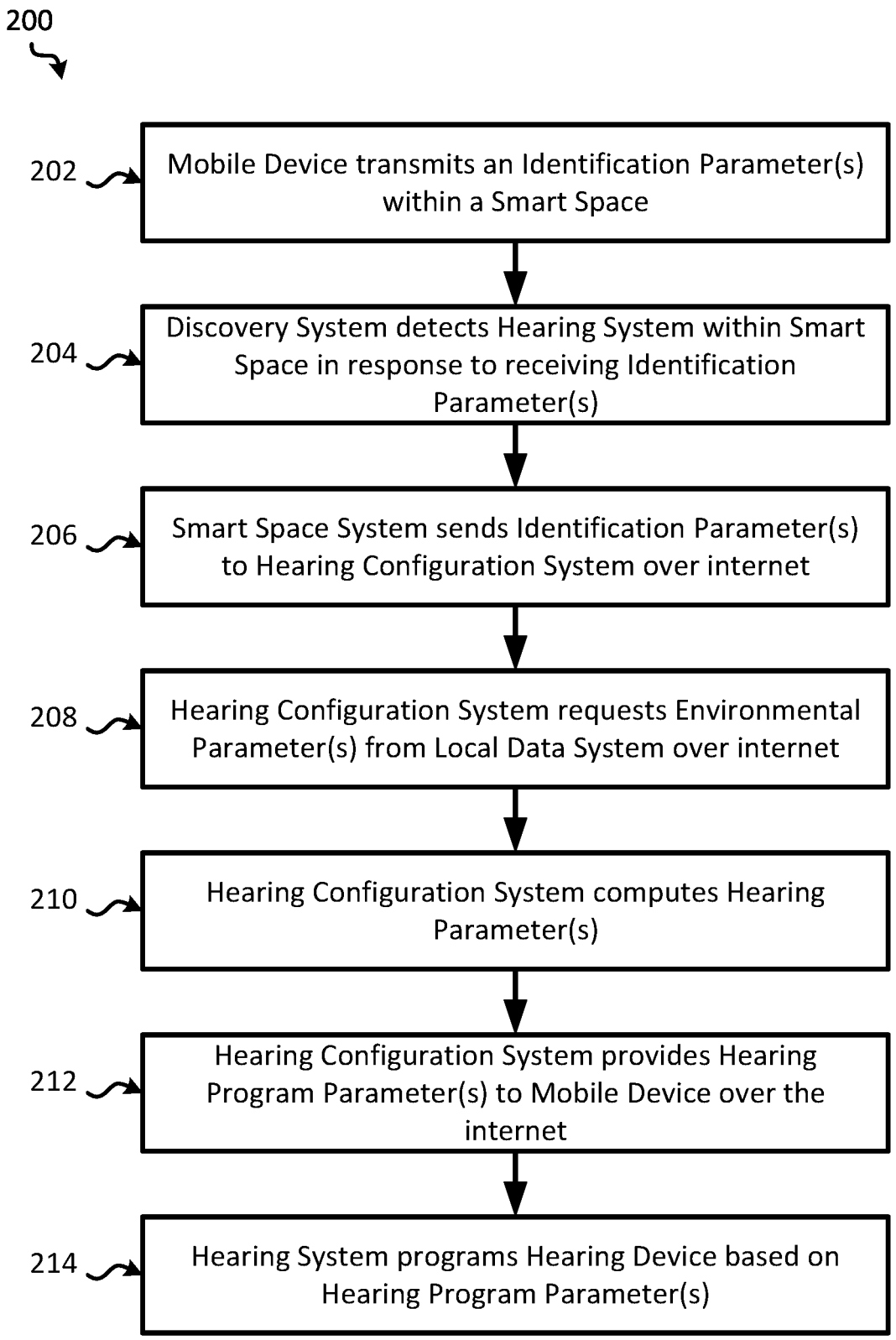
FIG. 6 is a process representation of an example implementation for the method of FIG. 2.

FIG. 5 is a schematic representation of an example configuration for the system 10. FIG. 6 is a representation of an example process 200 of implementing the basic process 100 (FIG. 2), which can be used with the configuration of the system 10 shown in FIG. 5. As perhaps best explained using a smart conference room as an example of the smart environment, a user can walk into the smart conference room or space 14. The mobile device 28 can discretely alert the user that enhanced listening services are available. The user can be offered the user's own prior conference room settings, settings other users have applied in the smart environment, a fine-tuning tool with adjustments specifically selected for the smart environment (for example, smartphone application), and/or an option to stream the videoconference audio directly to the hearing device 26.

Example process 200 begins with the smart space system 16 discovering the hearing system 12, which includes the hearing device 26, in response to the transmission of an identification parameter 32 into the smart environment (for example, using the "physical web" protocol). In steps 202 and 204, the mobile device 28 transmits an identification parameter (for example, acts like a beacon) in a manner that is discoverable by the discovery system 44 of the smart space system 16. Alternatively or in addition, the hearing device 26 itself can transmit the identification parameter 32 (for example, via low-power Bluetooth) in a manner discoverable by the discovery system 44.

In step 206, the smart space system 16 alerts a hearing configuration system 30 over the Internet 20 (for example, hosted by a hearing configuration service provider, such as Starkey) about the presence of the hearing device 26 corresponding to the identification parameter 32 within the smart space 14. In step 208, the hearing configuration system 30 contacts the local data system 40 and acquires an environmental parameter 36. In step 210, the hearing configuration system 30 computes the hearing program parameter 34. In step 212, the hearing configuration system 30 sends the hearing program parameter 34 to the mobile device 28 of the user. The mobile device 28 can optionally alert the user via a user interaction and optionally prompt the user to provide feedback or other input regarding the settings of the hearing device 26. For example, the user may identify whether the user likes a particular setting. In step 214, the mobile device 28 can send the hearing program parameter 34 to the hearing device to program the hearing device.

In some embodiments, the smart space system 16 can send a unique identifier for the local data system 40 to the mobile device 28 (or hearing device 26), which can request the environmental parameter 36 from the local data system 40. The mobile device 28 can then utilize the environmental parameter 36 to compute a hearing program parameter 34 or can send the environmental parameter 36 to the hearing configuration system 30 for computation.

Figure 7:
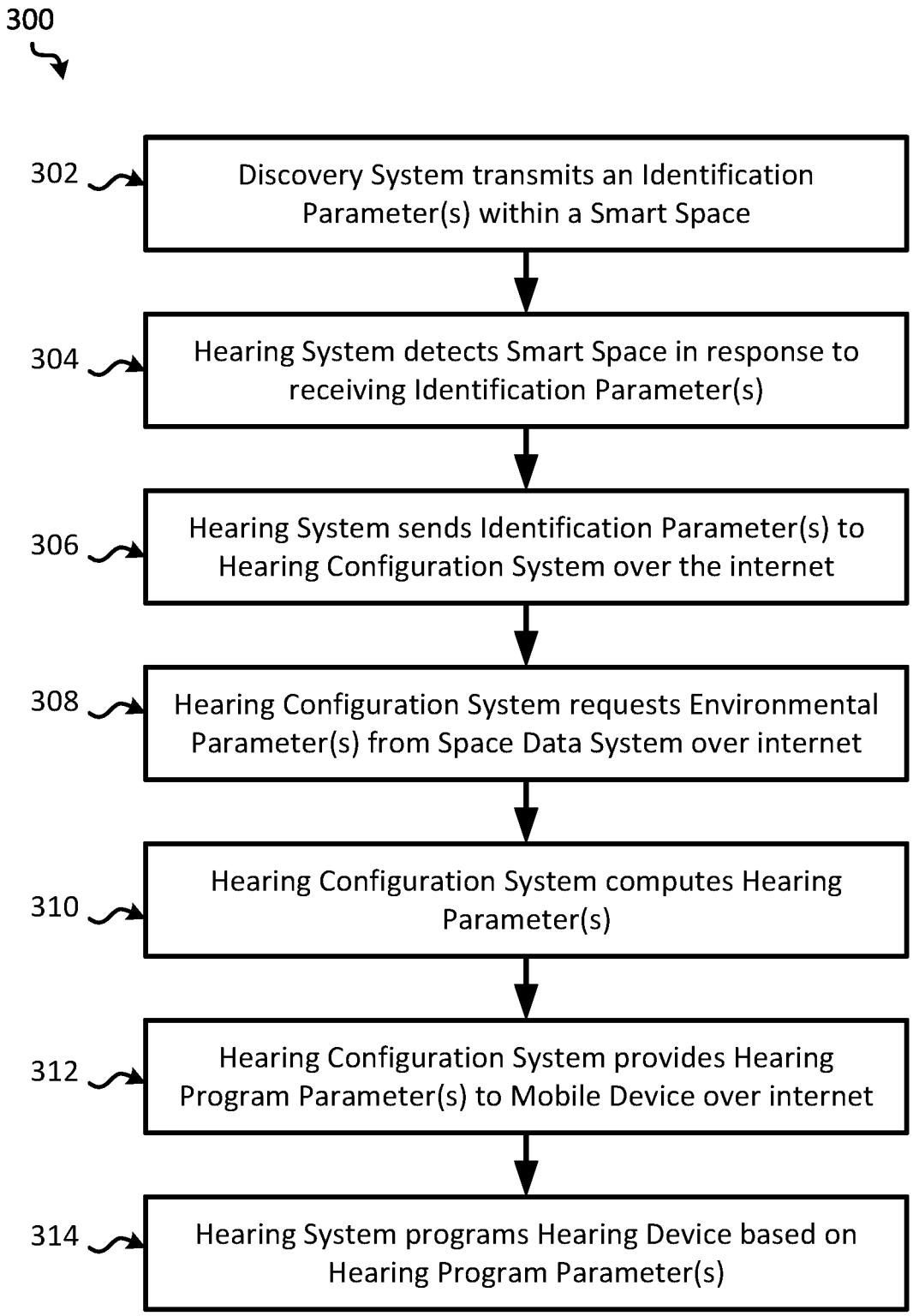
FIG. 7 is a process representation of another example implementation for the method of FIG. 2.

FIG. 7 is a representation of another example process 300. Process 300 is similar to process 200 (FIG. 6) and is numbered similarly for similar steps. However, example process 300 begins with the mobile device discovering the smart space system. In step 302, the smart space system transmits an identification parameter into the smart environment. In step 304, the hearing system detects the smart environment upon receiving the identification parameter. In step 306, the mobile device sends the identification parameter corresponding to the smart space system to the hearing configuration system over the Internet. In step 308, the hearing configuration system requests an environmental parameter from the local data system. Then, the hearing configuration system computes the hearing parameter in step 310, the hearing configuration system provides the hearing program parameter over the Internet to the mobile device (or hearing device) in step 312, and the hearing system programs the hearing device based on the hearing program parameter in step 314.

In some embodiments, the mobile device can use the identification parameter to directly request an environmental parameter form the local data system. The mobile device can then utilize the environmental parameter to compute a hearing program parameter or can send the environmental parameter to the hearing configuration system for computation.

Figure 8:
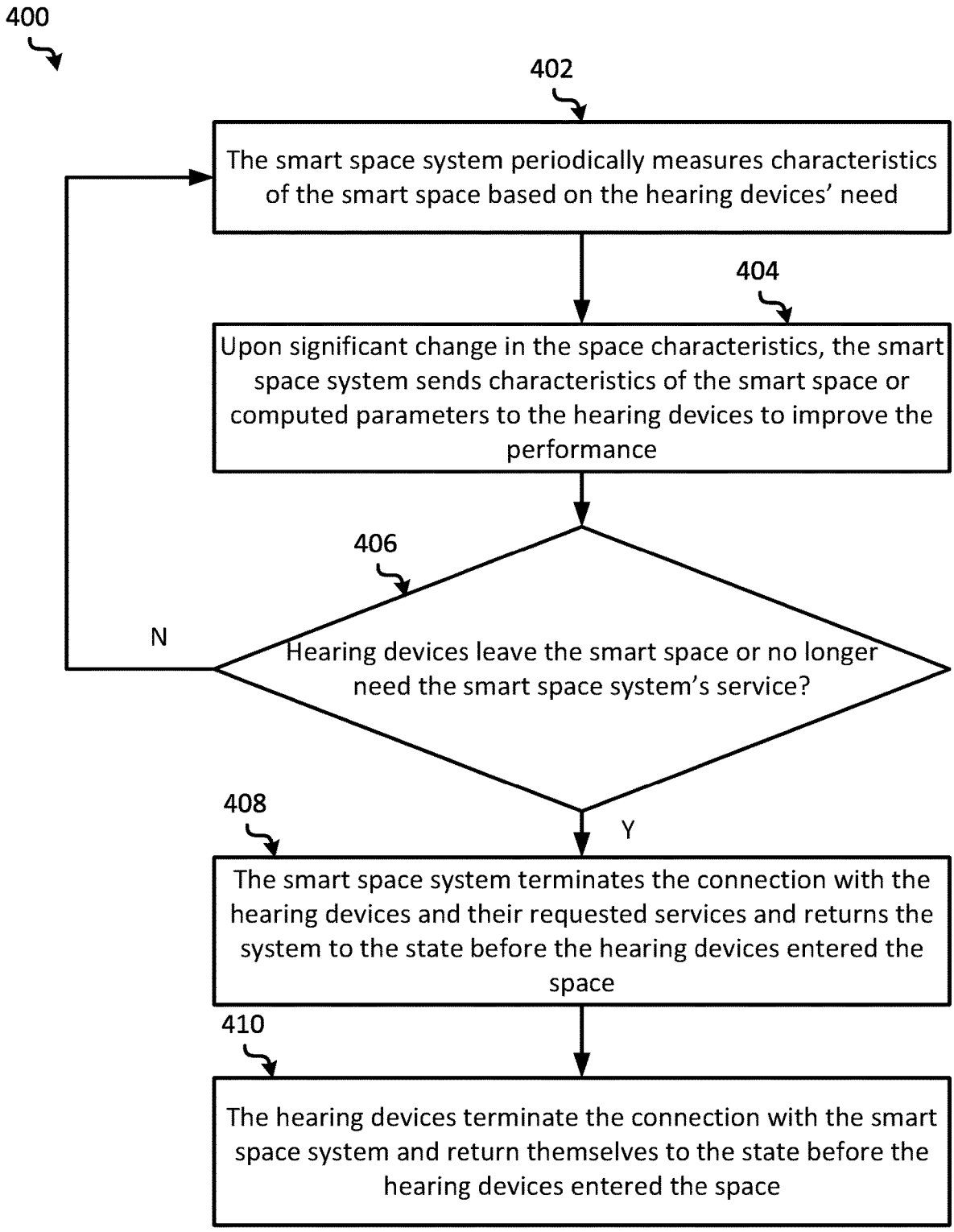
FIG. 8 is a flowchart representation of an example method for maintaining and terminating the connection between the hearing device and a smart space system.

FIG. 8 is a flowchart representation of one example of a method 400 for maintaining and terminating the connection between a hearing device and a smart space system. Once a connection has been established between hearing devices and the smart space system, the smart space system periodically measures the characteristics of the smart space based on needs of the hearing devices in process 402. Upon a significant change in the smart space characteristics, the smart space system may send the characteristics or computed parameters to the hearing devices to continuously improve their performance in process 404. Whether the hearing devices have left the smart space or no longer need services of the smart space system is determined in process 406. If the hearing devices continue to stay in the smart space and need services of the smart space, the connection may be maintained and the smart space system may continuously measure and update the hearing devices by returning to process 402. If the smart space system terminates the connection with the hearing devices and terminates their requested services, the smart space system may return to a system state from before the hearing devices entered the space in process 408. The method 400 may continue onto process 410, in which the hearing devices terminate the connection with the smart space system and return to their states from before the hearing devices entered the space.

Figure 9:
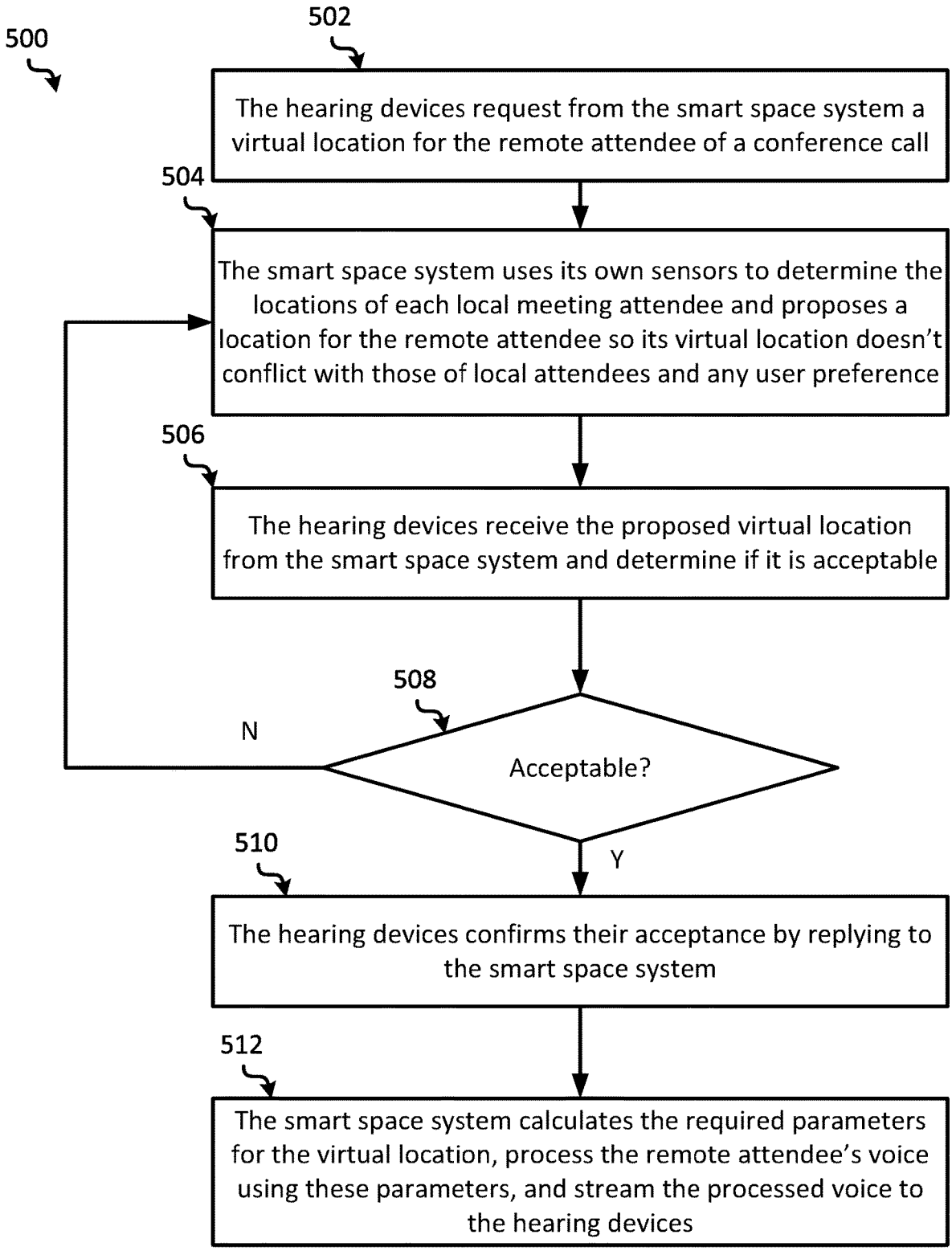
FIG. 9 is a flowchart representation of an example method of providing spatial enhancement for a hearing system in an indoor smart environment.

FIG. 9 is a flowchart representation of one example of a method 500 for providing spatial enhancement for hearing configuration in an indoor smart environment. Method 500 may be utilized when the user of a hearing device is attending a conference call in a smart room with several local attendees and one remote attendee. To improve listening comfort and reduce fatigue, it may be desirable to virtualize the voice of the remote attendee so the user may perceive that the remote attendee is sitting in the same smart room. To do so, the hearing devices may request that the smart space system determine a virtual position for the remote attendee in process 502. The smart space system may use its own sensors to determine the locations of every local attendee and may determine the virtual position to propose to the hearing devices user in process 504. The smart space system may determine a virtual position that does not conflict with the locations of local attendees and optionally may determine the virtual position according to at least one preference of the user. The hearing devices may receive the proposed virtual position in process 506. Whether the proposed virtual position is acceptable is determined in process 508. If not acceptable, the smart space system may be notified and may generate another proposed virtual position by returning to process 504. If acceptable, the hearing devices may confirm their acceptance of the proposed virtual position by replying to the smart space system in process 510. The smart space system may compute the required parameters for the accepted virtual position, process the voice of the remote attendee, and start streaming the processed voice to the hearing devices, in process 512. At the end of method 500, the user may be able to perceive the voice of the remote attendee as if the remote attendee is sitting at the accepted virtual position in the smart room.

Figure 10:
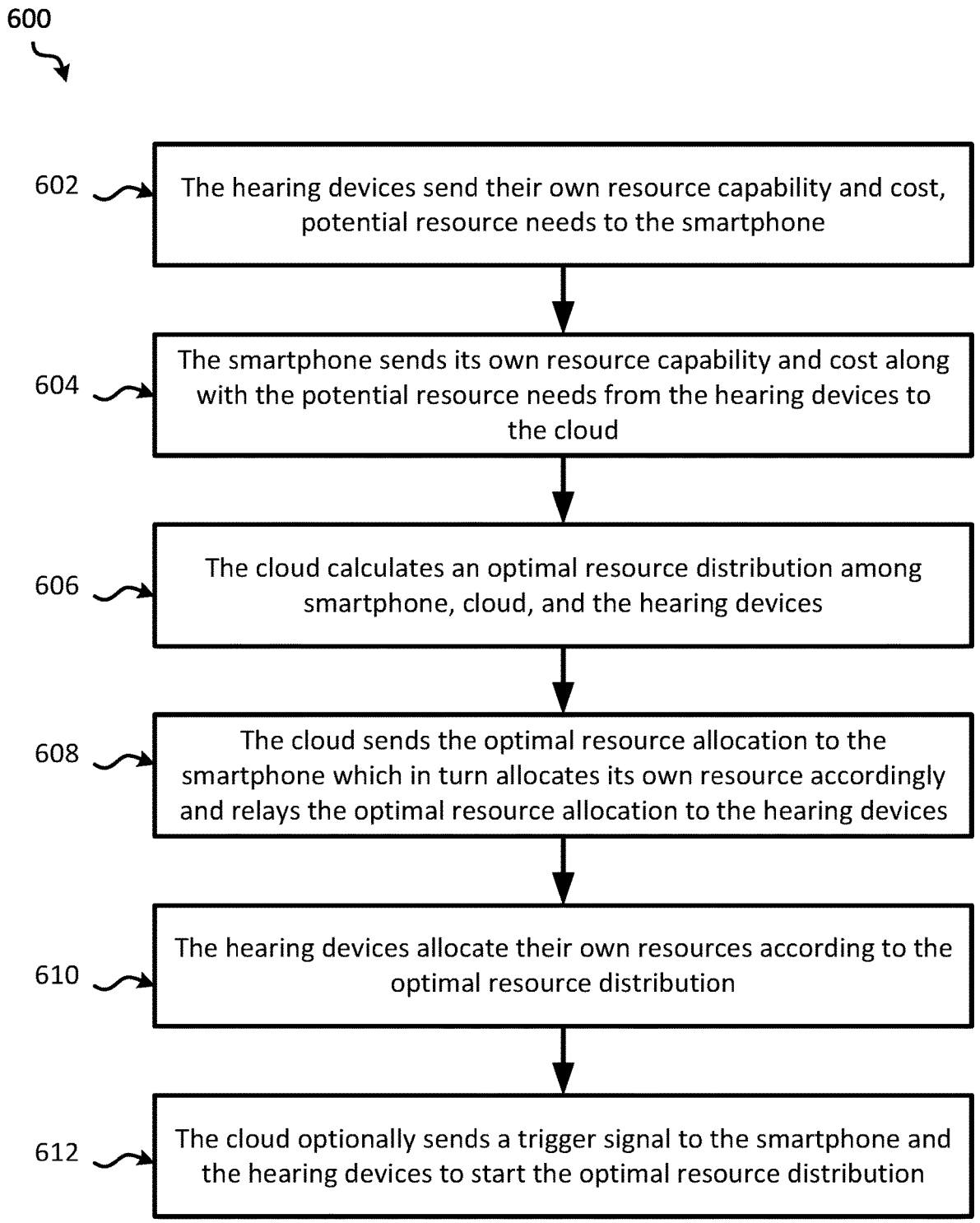
FIG. 10 is a flowchart representation of an example method of negotiating shared resources with the hearing system.

FIG. 10 is a flowchart representation of one example of a method 600 of negotiating shared resources between the smart space system and the hearing system. In process 602, the hearing devices may send their own resource capability (for example, computational power), cost (for example, current consumption including wireless communication), potential resource need (for example, required computational power), and objective (for example, optimize for current consumption) to a smartphone. The smartphone in turns may send its own resource capability and cost along with the resource information from the hearing devices to the cloud, over the Internet, in process 604. The cloud may be used to calculate an optimal resource distribution among the cloud, the smartphone, and the hearing devices, in process 606. The cloud may allocate its own resources accordingly and may send optimal resource allocations for the smartphone and hearing devices to the smartphone in process 608. The smartphone may allocate its own resource accordingly and may send optimal resource allocations for the hearing devices to each hearing device, and each hearing device may allocate its own resource according to the optimal resource allocation in process 610. Once resource allocation is complete, the cloud optionally sends a trigger signal to the smartphone and the hearing devices, over the Internet, to start the optimal resource allocation among the devices in process 612, which may facilitate achieving an objective overall resource distribution.

Illustrative Embodiments

In illustrative embodiment A, a system for adaptively configuring a hearing device comprises a hearing system. The hearing system comprises the hearing device. The hearing system is configured to connect to the Internet. The hearing system is further configured to transmit an identification parameter corresponding to the hearing system. The hearing system is also configured to receive a hearing program parameter over the Internet for configuring the hearing device when the hearing system is within a smart environment defined by a smart space system. The hearing program parameter is computed based on an environmental parameter measured within the smart environment by a sensor system of the smart space system. The hearing program parameter is sent to the hearing system over the Internet in response to a discovery system of the smart space system detecting the presence of the hearing system in the smart environment in response to receiving the identification parameter. The hearing system is still further configured to program the hearing device based on the hearing program parameter.

In illustrative embodiment A1, a system comprises the system according to illustrative embodiment A, wherein the hearing device is programmed automatically in response to the hearing program parameter being received.

In illustrative embodiment A2, a system comprises the system according to any one of the preceding illustrative embodiments, wherein the hearing device is programmed in response to the hearing program parameter being received and a user interaction.

In illustrative embodiment A3, a system comprises the system according to illustrative embodiment A2, wherein the user interaction comprises information provided to the user by the hearing system based on data provided by the smart space system and input from the user to the hearing system.

In illustrative embodiment A4, a system comprises the system according to any one of the preceding illustrative embodiments, wherein the environmental parameter is selected from acoustic data, non-acoustic data, or both.

In illustrative embodiment A5, a system comprises the system according to illustrative embodiment A4, wherein the acoustic data is selected from one or more of a sound level, a sound spectrum, and a reverberation characteristic.

In illustrative embodiment A6, a system comprises the system according to illustrative embodiment A4 or A5, wherein the non-acoustic data is selected from one or more of a number of occupants and a location of an audio source.

In illustrative embodiment A7, a system comprises the system according to any one of the preceding illustrative embodiments, wherein the hearing system further comprises a mobile device configured to connect to the Internet and configured to operatively connect to the hearing device to send the hearing program parameter to the hearing device.

In illustrative embodiment A8, a system comprises the system according to illustrative embodiment A7, wherein the mobile device is further configured to connect to the Internet to receive the environmental parameter over the Internet, and compute the hearing program parameter based on the environmental parameter before sending the hearing program parameter to the hearing device.

In illustrative embodiment A9, a system comprises the system according to any one of the preceding illustrative embodiments, wherein the hearing system is further configured to receive the hearing program parameter. The hearing program parameter is computed by a hearing configuration system that is remote from the smart environment. The hearing configuration system is also configured to connect to the Internet to receive the environmental parameter and the identification parameter and to send the hearing program parameter to the hearing system.

In illustrative embodiment A10, a system comprises the system according to illustrative embodiment A9, wherein the smart space system is further configured to send the identification parameter to the hearing configuration system over the Internet to indicate that the hearing system is within the smart environment.

In illustrative embodiment A11, a system comprises the system according to any one of the preceding illustrative embodiments, wherein the smart space system further comprises a local data system configured to connect to the Internet and configured to send the environmental parameter.

In illustrative embodiment A12, a system comprises the system according to illustrative embodiment A11, wherein the local data system is remote from the smart environment, the local data system being configured to connect to the Internet and further configured to receive the environmental parameter from the smart space system over the Internet. The local data system is also configured to receive a request from the hearing configuration system for the environmental parameter over the Internet. The local data system is still further configured to send the environmental parameter to the hearing configuration system over the Internet in response to the request.

In illustrative embodiment A13, a system comprises the system according to any one of the preceding illustrative embodiments, wherein the hearing system transmits the identification parameter in response to receiving a broadcasted identification parameter transmitted from the smart space system within the smart environment.

In illustrative embodiment A14, a system comprises the system according to any one of the preceding illustrative embodiments, wherein the hearing system is configured to receive content data provided by the smart space system including at least one of a direct or composite room microphone feed, a videoconference audio stream, a teleconference audio stream, background music, and advertising.

In illustrative embodiment B, a system for adaptively configuring a hearing device comprises a hearing system comprising the hearing device. The hearing system is configured to connect to the Internet. The hearing system is further configured to detect the presence of a smart environment defined by a smart space system comprising a sensor system and a discovery system when the hearing system is within the smart environment. The sensor system is configured to measure an environmental parameter within the smart environment. The smart space system is configured to connect to the Internet to send the environmental parameter. The discovery system is configured to broadcast an identification parameter within the smart environment. The hearing system is also configured to receive the broadcasted identification parameter from the smart space system corresponding to the hearing system. The hearing system is still further configured to send the broadcasted identification parameter over the Internet. The hearing system is yet further configured to receive a hearing program parameter over the Internet computed based on the environmental parameter for configuring the hearing device. The hearing system is additionally configured to program the hearing device based on the hearing program parameter.

In illustrative embodiment B1, a system comprises the system according to illustrative embodiment B, wherein the broadcasted identification parameter corresponds to the smart space system, and wherein the hearing system is further configured to send the broadcasted identification parameter over the Internet to a hearing configuration system. The hearing configuration system is configured to request the environmental parameter over the Internet from a local data system configured to receive the environmental parameter from the smart space system in response to receiving the broadcasted identification parameter.

In illustrative embodiment B1, a system comprises the system according to illustrative embodiments B or B1, wherein the hearing system is further configured to request the environmental parameter from a local data system configured to send the environmental parameter.

In illustrative embodiment C, a method for adaptively configuring a hearing device comprises detecting when a hearing system comprising the hearing device enters a smart environment defined by a discovery system of a smart space system. The smart space system comprises a sensor system configured to measure an environmental parameter within the smart environment. The smart space system is configured to connect to the Internet to send the environmental parameter over the Internet. The method further comprises sending an identification parameter over the Internet to initiate a request for the environmental parameter. The identification parameter corresponds to at least one of the smart space system and the hearing system. The method also comprises receiving a hearing program parameter computed based on the environmental parameter over the Internet. The method still further comprises programming the hearing device based on the hearing program parameter.

In illustrative embodiment C1, a method comprises the method of illustrative embodiment C, further comprising receiving a user interaction to confirm that the programmed hearing device is acceptable to the user.

In illustrative embodiment C2, a method comprises the method according to illustrative embodiment C1, further comprising confirming that the programmed hearing device is acceptable to the user based on user interaction voice data sent over the Internet.

In illustrative embodiment C3, a method comprises the method according to any one of illustrative embodiments C to C2, further comprising providing a parameter measured by the hearing system to the smart space system.

In illustrative embodiment C4, a method comprises the method according to any one of illustrative embodiments C to C3, further comprising computing the hearing program parameter based on multiple measurements of one or more environmental parameters over time.

In illustrative embodiment C5, a method comprises the method according to any one of illustrative embodiments C to C4, further comprising computing the hearing program parameter based on a desired virtual location of a sound source such that the user perceives the generated sound from the hearing devices at the desired location.

In illustrative embodiment C6, a method comprises the method according to any one of illustrative embodiments C to C5, further comprising continuously measuring characteristics of the smart space system based on needs of the hearing device.

In illustrative embodiment C7, a method comprises the method according to any one of illustrative embodiments C to C6, further comprising terminating a service of the smart space system when the hearing device is outside the smart space or the hearing device is no longer using the service of the smart space system.

In illustrative embodiment C8, a method comprises the method according to any one of illustrative embodiments C to C7, further comprising optimizing resource allocations among the hearing device system, the smart space system, and the cloud based on at least one of: needs, capability, and cost.

In illustrative embodiment C9, a method comprises the method according to illustrative embodiment C8, further comprising optimizing current consumption by distributing computational load among the hearing device system, the smart space system, and the cloud based on computational power and current consumption of each system.

In illustrative embodiment C10, a method comprises the method according to illustrative embodiment C8 or C9, further comprising further comprising receiving a trigger signal over the Internet to start a resource allocation for the hearing system based on the optimized resource allocations.

Thus, embodiments of the IMPROVED LISTENING EXPERIENCES FOR SMART ENVIRONMENTS USING HEARING DEVICES are disclosed. Although reference is made to the accompanying set of drawings that form a part hereof and in which are shown by way of illustration several specific embodiments, it is to be understood that other embodiments are contemplated and may be made without departing from (for example, still falling within) the scope or spirit of the present disclosure. The detailed description, therefore, is not to be taken in a limiting sense.

All references and publications cited herein are expressly incorporated herein by reference in their entirety into this disclosure, except to the extent they may directly contradict this disclosure.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The terms "coupled", "connected", "operatively coupled," or "operatively connected" refer to elements that can interact with each other either directly or indirectly (having one or more elements between the two elements) to perform certain functionality.

For example, two devices may be operatively connected to communicate over a wired or wireless protocol (for example, peer-to-peer, networked, or over the Internet) for sending or receiving data. As another example, a device may be operatively connected to the Internet to provide data or send data over the Internet.

Reference to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout are not necessarily referring to the same embodiment of the disclosure. Furthermore, the particular features, configurations, compositions, or characteristics may be combined in any suitable manner in one or more embodiments.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The term "and/or" means one or all of the listed elements or a combination of any two or more of the listed elements (for example, casting and/or treating an alloy means casting, treating, or both casting and treating the alloy).

The phrases "at least one of," "comprises at least one of," and "one or more of" followed by a list refers to any one of the items in the list and any combination of two or more items in the list.

The invention claimed is:

1. A system for adaptively configuring a hearing device, the system comprising:

a hearing system comprising the hearing device, the hearing system configured to connect to the Internet and further configured to:

transmit an identification parameter corresponding to the hearing system;

receive a hearing program parameter over the Internet for configuring the hearing device when the hearing system is within a smart environment defined by a smart space system, the hearing program parameter including a hearing aid setting computed based on an environmental parameter measured within the smart environment to characterize acoustics of the smart environment by a sensor system of the smart space system, the hearing program parameter being sent to the hearing system over the Internet in response to a discovery system of the smart space system detecting the presence of the hearing system in the smart environment in response to receiving the identification parameter;

send the identification parameter over the Internet to a hearing configuration system, wherein the hearing configuration system is configured to request the environmental parameter over the Internet from a local data system configured to receive the environmental parameter from the smart space system in response to receiving the identification parameter; and program the hearing device based on the hearing program parameter.

2. The system according to claim 1, wherein the hearing device is programmed automatically in response to the hearing program parameter being received.

3. The system according to claim 1, wherein the hearing device is programmed in response to the hearing program parameter being received and a user interaction.

4. The system according to claim 3, wherein the user interaction comprises information provided to the user by the hearing system based on data provided by the smart space system and input from the user to the hearing system.

5. The system according to claim 1, wherein the environmental parameter is selected based on acoustic data, non-acoustic data, or both.

6. The system according to claim 5, wherein the acoustic data comprises one or more of: a sound level, a sound spectrum, and a reverberation characteristic.

7. The system according to claim 5, wherein the non-acoustic data comprises one or more of: a number of occupants, and a location of an audio source via infrared sensors.

8. The system according to claim 1, wherein the hearing system further comprises a mobile device configured to connect to the Internet and configured to operatively connect to the hearing device to send the hearing program parameter to the hearing device.

9. The system according to claim 1, wherein the hearing system is configured to receive content data provided by the smart space system including at least one of a direct or composite room microphone feed, a videoconference audio stream, a teleconference audio stream, background music, and advertising.

10. A system for adaptively configuring a hearing device, the system comprising:

a hearing system comprising the hearing device, the hearing system configured to connect to the Internet and further configured to:

detect the presence of a smart environment defined by a smart space system comprising a sensor system and a discovery system when the hearing system is within the smart environment, the sensor system configured to measure an environmental parameter within the smart environment to characterize acoustics of the smart environment, the smart space system configured to connect to the Internet to send the environmental parameter, the discovery system configured to broadcast an identification parameter within the smart environment;

receive the broadcasted identification parameter from the smart space system corresponding to the hearing system;

send the broadcasted identification parameter over the Internet to a hearing configuration system, wherein the hearing configuration system is configured to request the environmental parameter over the Internet from a local data system configured to receive the environmental parameter from the smart space system in response to receiving the broadcasted identification parameter;

receive a hearing program parameter including a hearing aid setting over the Internet computed based on the environmental parameter for configuring the hearing device; and program the hearing device based on the hearing program parameter.

11. A method for adaptively configuring a hearing device, the method comprising:

detecting when a hearing system comprising the hearing device enters a smart environment defined by a discovery system of a smart space system, the smart space system further comprising a sensor system configured to measure an environmental parameter within the smart environment to characterize acoustics of the smart environment, the smart space system configured to connect to the Internet to send the environmental parameter over the Internet;

sending an identification parameter over the Internet to a hearing configuration system, wherein the hearing configuration system is configured to request the environmental parameter over the Internet from a local data system configured to receive the environmental parameter from the smart space system in response to receiving the identification parameter, the identification parameter corresponding to at least one of the smart space system and the hearing system;

receiving a hearing program parameter including a hearing aid setting computed based on the environmental parameter over the Internet; and programming the hearing device based on the hearing program parameter.

12. The method according to claim 11, further comprising receiving a user interaction to confirm that the programmed hearing device is acceptable to the user.

13. The method according to claim 11, further comprising computing the hearing program parameter based on a desired virtual location of a sound source such that the user perceives the generated sound from the hearing devices at the desired location.

14. The method according to claim 11, further comprising continuously measuring characteristics of the smart space system based on needs of the hearing device.

15. The method according to claim 11, further comprising terminating a service of the smart space system when the hearing device is outside the smart space or the hearing device is no longer using the service of the smart space system.

16. The method according to claim 11, further comprising optimizing resource allocations among the hearing device system, the smart space system, and the cloud based on at least one of: needs, capability, and cost.

17. The method according to claim 16, further comprising optimizing current consumption by distributing computational load among the hearing device system, the smart space system, and the cloud based on computational power and current consumption of each system.

18. The method according to claim 16, further comprising receiving a trigger signal over the Internet to start a resource allocation for the hearing system based on the optimized resource allocations.

* * * * *